US007275579B2

(12) United States Patent
Ballarotti

(10) Patent No.: US 7,275,579 B2
(45) Date of Patent: Oct. 2, 2007

(54) LABELING MACHINE FOR PRISM-SHAPED BOTTLES HAVING AN AXIALLY-OFFSET NECK

(75) Inventor: Mario Ballarotti, Marmirolo (IT)

(73) Assignee: P.E. S.R.L., Porto Mantovano (IT)

( * ) Notice: Subject to any disclaimer, the term of this patent is extended or adjusted under 35 U.S.C. 154(b) by 169 days.

(21) Appl. No.: 10/981,516

(22) Filed: Nov. 5, 2004

(65) Prior Publication Data

US 2005/0098269 A1 May 12, 2005

(30) Foreign Application Priority Data

Nov. 11, 2003 (IT) ..... MN2003A0040

(51) Int. Cl.
*B65C 3/06* (2006.01)
*B65C 9/02* (2006.01)

(52) U.S. Cl. ..... 156/567; 156/DIG. 12; 156/DIG. 25; 156/566; 156/556; 156/542

(58) Field of Classification Search ..... 156/567, 156/DIG. 1, DIG. 9, 521, 542, 566, 556, 156/DIG. 25, DIG. 12
See application file for complete search history.

(56) References Cited

U.S. PATENT DOCUMENTS

| | | | | |
|---|---|---|---|---|
| 4,239,569 | A | 12/1980 | Harvey | |
| 4,798,648 | A | 1/1989 | Freeman et al. | |
| 5,650,037 | A * | 7/1997 | Larson | 156/540 |
| 5,709,770 | A | 1/1998 | Asghar et al. | |
| 6,328,832 | B1 * | 12/2001 | Otruba et al. | 156/64 |

FOREIGN PATENT DOCUMENTS

| | | |
|---|---|---|
| DE | 75 23 323 U | 11/1975 |
| DE | 197 41 476 A1 | 3/1999 |

* cited by examiner

*Primary Examiner*—Linda Gray
(74) *Attorney, Agent, or Firm*—Modiano & Associati; Albert Josif; Daniel O'Byrne

(57) ABSTRACT

A labeling machine for prism-shaped bottles having an axially-offset neck, comprising a first carousel, which conveys the bottles to a first labeling assembly, which applies the labels to one of the faces, and a second carousel, which conveys the bottles to a second labeling assembly, which applies the labels to an opposite face; the carousels are connected in series by at least one pair of bottle transfer devices.

3 Claims, 1 Drawing Sheet

LABELING MACHINE FOR PRISM-SHAPED BOTTLES HAVING AN AXIALLY-OFFSET NECK

BACKGROUND OF THE INVENTION

The invention relates to a labeling machine for prism-shaped bottles having an axially-offset neck.

It is known that prism-shaped bottles are provided with a neck in which the axis is offset with respect to the vertical axis of the bottles, such bottles being designed to receive a label on two opposite faces.

Conventional labeling machines comprise a rotating carousel for supporting the bottles, which are kept in position by being gripped by jacks at the neck; such carousel carries the bottles to a first labeling assembly, which applies the label to one of their faces, and then, after a rotation of the bottles about the axis of the neck, to a second labeling assembly, which applies the label to the other face.

In this way, however, two disadvantageous characteristics are suffered: the first is the need to provide, for each bottle, a considerable portion of space on the carousel, and the second is the fact that each bottle cannot be in the optimum condition for receiving the label in the two positions assumed respectively before and after rotation.

SUMMARY OF THE INVENTION

The aim of the present invention is therefore to provide a labeling machine that has high productivity and ensures optimum functional characteristics.

This aim and others that will become better apparent hereinafter, are achieved by a labeling machine for prism-shaped bottles having an axially-offset neck, according to the invention, characterized in that it comprises a first carousel, which receives bottles from input means and conveys said bottles to a first labeling assembly, which applies labels to one of the faces of said bottles, and a second carousel, which is connected to output means and conveys the bottles to a second labeling assembly, which applies the labels to an opposite face of the bottles, said carousels being connected in series by at least one pair of bottle transfer devices.

BRIEF DESCRIPTION OF THE DRAWINGS

Further characteristics and advantages of the invention will become better apparent from the description of a preferred but not exclusive embodiment of the invention, illustrated by way of non-limiting example in the accompanying drawings, wherein.

DESCRIPTION OF THE PREFERRED EMBODIMENTS

Figure 1:
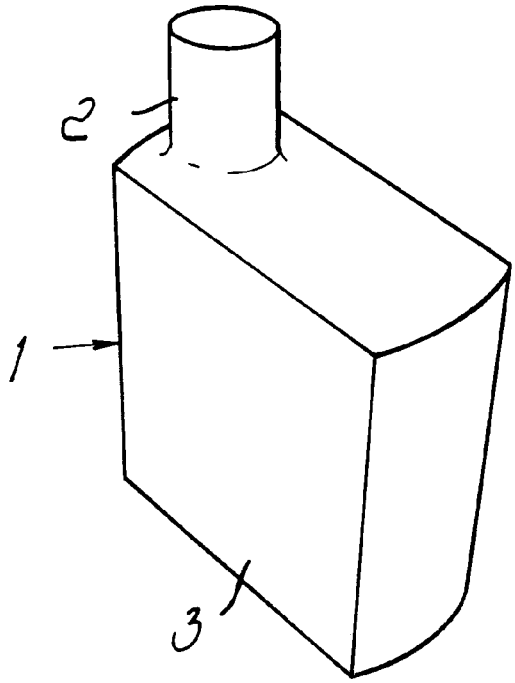
FIG. 1 is a view of a bottle of the type to be processed by the machine.
Figure 2:
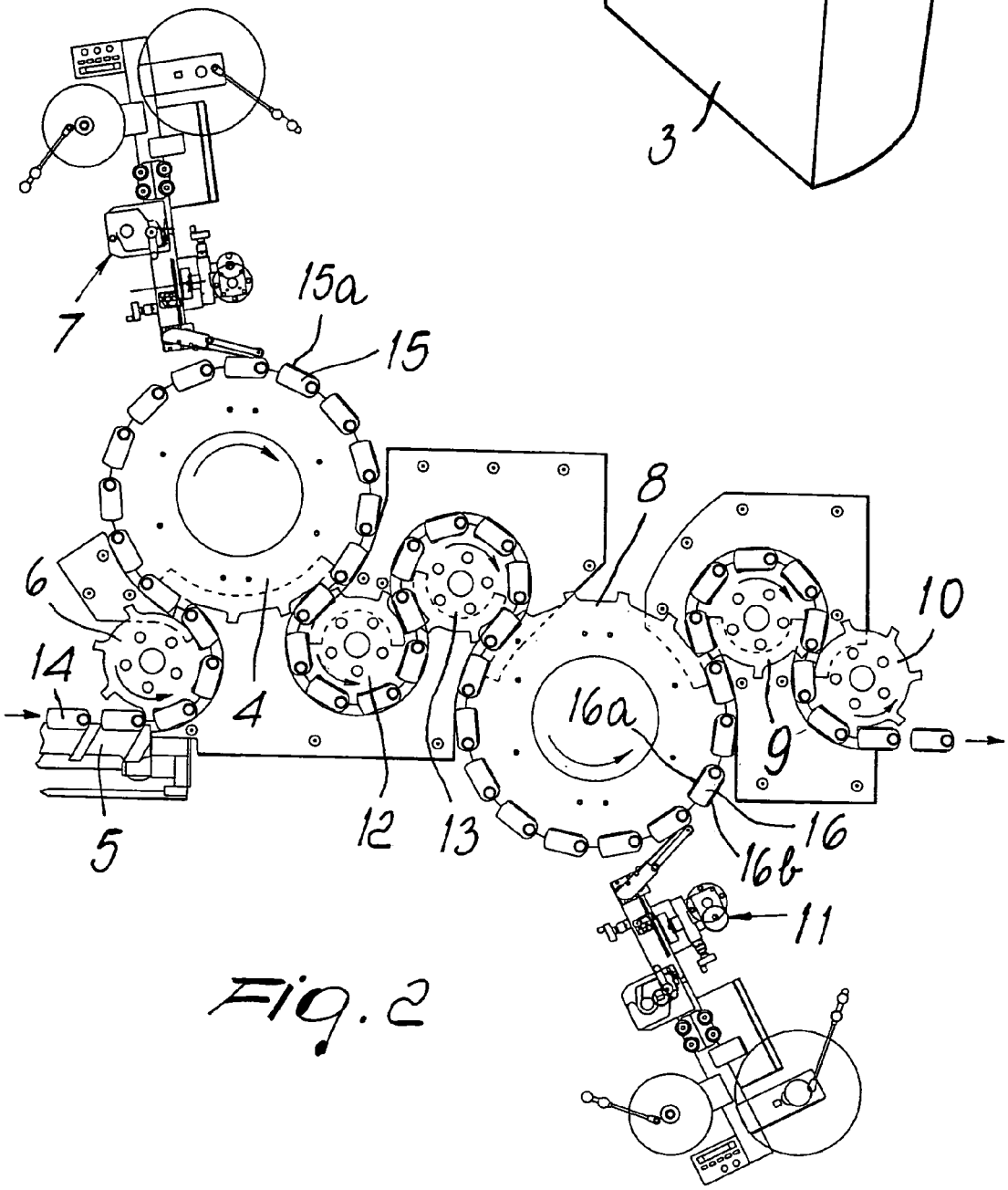
FIG. 2 is a schematic plan view of the machine according to the invention.

With reference to FIG. 1, the reference numeral 1 designates a bottle that has a prism-like shape and an axially-offset neck 2 and whereto at least one label is to be applied on a face 3 and on the opposite face.

The machine according to the invention comprises a first carousel 4, which receives the bottles from input means, which comprise a screw feeder 5 and a star conveyor 6, and brings them to a first labeling assembly 7, which is designed to apply labels to one of the faces of the bottles.

The reference numeral 8 further designates a second carousel, which is connected to output means that comprise star conveyors 9 and 10 and brings the bottles to a second labeling assembly 11, which applies labels to the other face of the bottles; the first and second carousels are connected in series by at least two transfer devices, which are constituted by star conveyors 12 and 13.

Bottles such as 14 enter the machine by being introduced by the screw feeder 5 and by the star conveyor 6, and are conveyed by the carousel 4 so that they receive, on one face, a label from the labeling assembly 7.

Reference numeral 15 designates the bottle that has just received, from said assembly, a label 15*a* on the face that is located toward the outside of the carousel; all the bottles that precede it have likewise already received a label, and all the bottles that follow it lack a label.

In output from the carousel 4, the bottles are taken first by the star conveyor 12 and then by the star conveyor 13, and thus reach the carousel 8 and are taken on board it so that their labeled face is directed inwardly and the face to be labeled is directed outwardly and is therefore available to receive labels from the assembly 11: reference numeral 16 designates the bottle which, after receiving a label 16*a*on one face from the assembly 7, has just received from the assembly 11 a label 16*b* on the opposite face.

The fully labeled bottles can then exit from the machine, being conveyed by the output means, which comprise the star conveyors 9 and 10.

The described invention is susceptible of numerous modifications and variations, all of which are within the scope of the appended claims; thus, for example, the devices for transferring the bottles from the carousel 4 to the carousel 8 may comprise a plurality of pairs of star conveyors such as 12 and 13, or may comprise one or more pairs of aligned screw feeders.

The disclosures in Italian Patent Application no. MN2003A000040, from which this application claims priority, are incorporated herein by reference.

What is claimed is:

1. A labeling machine for prism-shaped bottles having an axially-offset neck, comprising a first conveying carousel, which receives the bottles from input means and conveys said bottles from said input means about an extended circular path of said first conveying carousel to a first labeling assembly, which applies labels to one of the faces of said bottles, and a second conveying carousel, which is connected to output means and conveys the bottles about an extended circular path of said second conveying carousel to a second labeling assembly, which applies the labels to an opposite face of the bottles, said first and second conveying carousels being connected in series by at least one pair of bottle transfer devices.

2. The labeling machine according to claim 1, wherein the first and second conveying carousels are connected in series by at least one pair of star conveyors for transferring the bottles.

3. The labeling machine according to claim 1, wherein the first and second conveying carousels are connected in series by at least one pair of aligned screw feeders for transferring the bottles.

* * * * *